US011787587B2

(12) United States Patent
Kregel et al.

(10) Patent No.: US 11,787,587 B2
(45) Date of Patent: Oct. 17, 2023

(54) CONTAINER PROCESSING APPARATUS AND METHOD

(71) Applicant: Mars, Incorporated, McLean, VA (US)

(72) Inventors: Gebhard Kregel, Verden (DE); Andrey Glukhov, Verden (DE); Marco Heuver, Verden (DE)

(73) Assignee: Mars, Incorporated, McLean, VA (US)

( * ) Notice: Subject to any disclaimer, the term of this patent is extended or adjusted under 35 U.S.C. 154(b) by 119 days.

(21) Appl. No.: 17/310,142

(22) PCT Filed: Jan. 21, 2020

(86) PCT No.: PCT/EP2020/051406
§ 371 (c)(1),
(2) Date: Jul. 20, 2021

(87) PCT Pub. No.: WO2020/152162
PCT Pub. Date: Jul. 30, 2020

(65) Prior Publication Data

US 2022/0063857 A1 Mar. 3, 2022

(30) Foreign Application Priority Data

Jan. 21, 2019 (GB) ..... 1900818

(51) Int. Cl.
*B65B 65/00* (2006.01)
*B65B 25/00* (2006.01)
(Continued)

(52) U.S. Cl.
CPC ..... *B65B 65/003* (2013.01); *B65B 25/001* (2013.01); *B65B 31/041* (2013.01);
(Continued)

(58) Field of Classification Search
CPC .... B65B 1/32; B65B 1/46; B65B 3/28; B65B 25/001; B65B 31/041; B65B 43/26;
(Continued)

(56) References Cited

U.S. PATENT DOCUMENTS 418,887 A * 1/1890 Casey et al. ..... B65B 19/18 53/169
959,577 A * 5/1910 McEwan ..... B65B 43/50 141/181
(Continued)

FOREIGN PATENT DOCUMENTS

DE 102016003227 B3 3/2017
EP 0546394 A1 6/1993
(Continued)

OTHER PUBLICATIONS

International Search Report and Written Opinion issued in International Application No. PCT/EP2020/051406 dated Apr. 24, 2020 (16 pages).

*Primary Examiner* — Stephen F. Gerrity
(74) *Attorney, Agent, or Firm* — Bookoff McAndrews, PLLC

(57) ABSTRACT

The present invention provides an apparatus for receiving and processing containers by conducting a plurality of processing steps, the apparatus comprising a plurality of processing stations, wherein the apparatus is configured such that a processing step is conducted at each processing station, wherein the plurality of processing stations comprises an infeed station for receiving the containers; a filling station for filling the containers with a product; and an output station for dispensing the filled containers; wherein the apparatus is configured to move the containers through the plurality of processing stations in a rotary manner about a substantially horizontal central axis.

32 Claims, 2 Drawing Sheets

(51) Int. Cl.

| | |
|---|---|
| ***B65B 31/04*** | (2006.01) |
| ***B65B 43/26*** | (2006.01) |
| ***B65B 43/50*** | (2006.01) |
| ***B65B 43/60*** | (2006.01) |
| ***B65B 51/22*** | (2006.01) |
| ***B65B 57/10*** | (2006.01) |

(52) U.S. Cl.
CPC ..... *B65B 43/26* (2013.01); *B65B 43/50* (2013.01); *B65B 43/60* (2013.01); *B65B 51/225* (2013.01); *B65B 57/10* (2013.01)

(58) Field of Classification Search
CPC ..... B65B 43/465; B65B 43/50; B65B 43/60; B65B 65/003
USPC ..... 53/407, 89, 253, 284.5, 284.7, 502, 570, 53/266.1, 276, 299
See application file for complete search history.

(56) References Cited

U.S. PATENT DOCUMENTS 2,092,786 A * 9/1937 Taylor ..... B26D 7/0608 99/545
3,616,493 A * 11/1971 Okubo et al. ..... B65B 1/24 425/347
3,675,390 A * 7/1972 Austin ..... B65B 43/60 53/201
4,115,978 A 9/1978 Langemeyer et al.
4,262,708 A 4/1981 De Echeandia et al.
5,669,205 A * 9/1997 Rice et al. ..... G03B 17/26 53/118
5,673,535 A * 10/1997 Jagger ..... B65B 55/025 198/803.14
6,136,254 A * 10/2000 Weber ..... B29C 49/36 425/444
8,539,743 B2 * 9/2013 Rapparini ..... B65B 9/042 53/511
2004/0079051 A1 * 4/2004 Lippman et al. ..... B65B 51/142 53/284.5
2004/0206056 A1 * 10/2004 Hiramoto et al. ..... B65B 5/022 53/562
2007/0062163 A1 3/2007 Cook et al.
2009/0233778 A1 * 9/2009 Tsutsui et al. ..... B65B 3/02 493/212
2010/0242972 A1 9/2010 Thierig et al.
2018/0208407 A1 * 7/2018 Ruge et al. ..... B65B 35/26

FOREIGN PATENT DOCUMENTS

IE 81014 B1 9/1999
WO WO-8101137 A1 * 4/1981 ..... B65B 43/60
WO 2017137875 A1 8/2017

* cited by examiner

CONTAINER PROCESSING APPARATUS AND METHOD

CROSS-REFERENCE TO RELATED APPLICATION(S)

This application is the U.S. National Phase Entry under 35 U.S.C. § 371 of International Application No. PCT/EP2020/051406, filed on Jan. 21, 2020. The International Application No. PCT/EP2020/051406 claims priority to GB Application No. 1900818.4, filed on Jan. 21, 2019 which is incorporated by reference herein in its entirety.

TECHNICAL FIELD

The present invention relates to an apparatus for receiving and processing containers. The invention further relates to a method of processing a container and utilising the apparatus.

BACKGROUND

Many consumer products are provided in containers, such as pouches and trays. Individual portions of the products have to be dispensed into these containers in an efficient and reliable manner during their production. Therefore, there is a continual need to provide reliable and efficient apparatus for filling containers.

DETAILED DESCRIPTION

Figure 1:
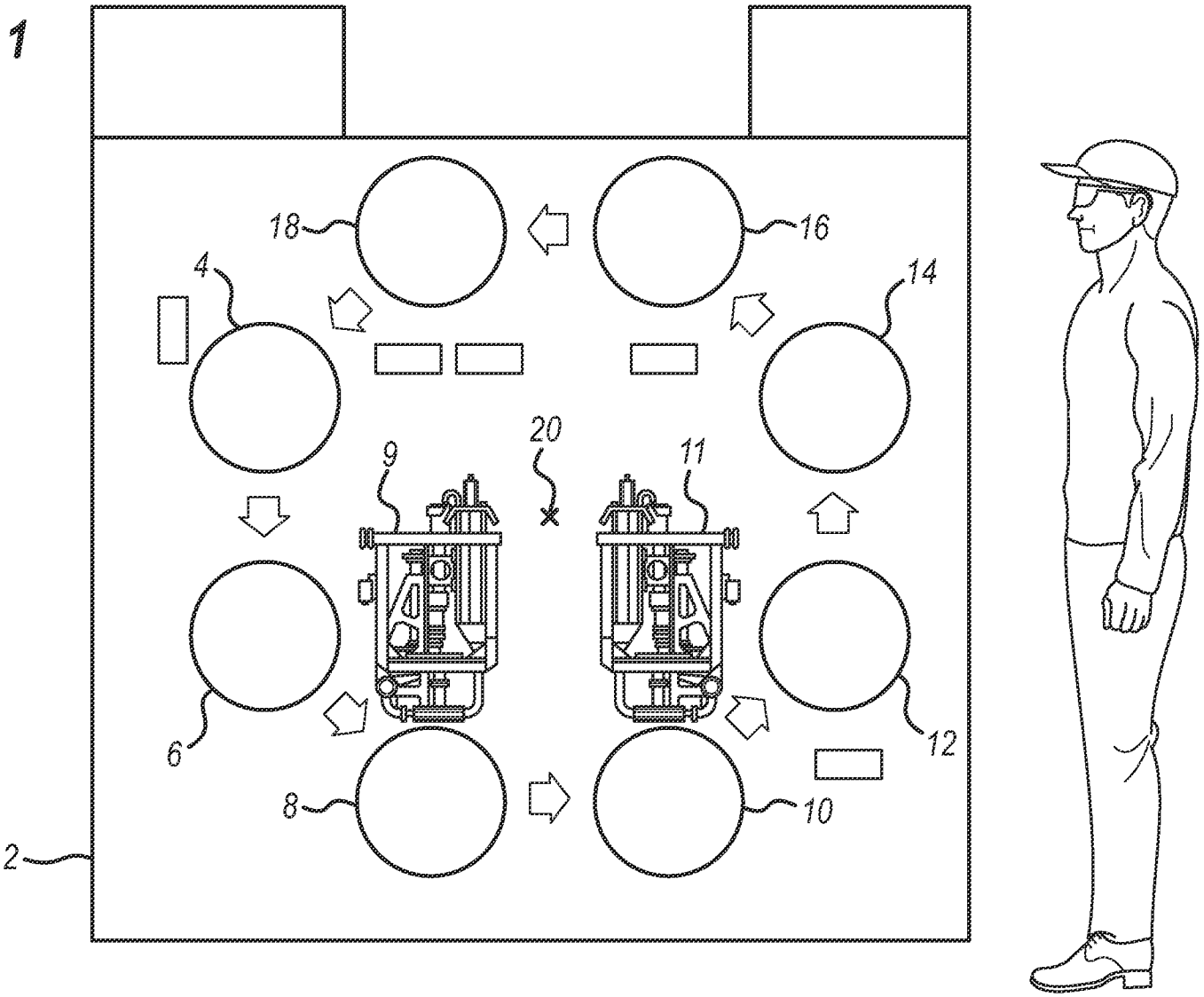
FIG. 1 depicts a schematic representation of an apparatus of the present invention.

The present invention provides an apparatus for receiving and processing containers by conducting a plurality of processing steps, the apparatus comprising a plurality of processing stations, wherein the apparatus is configured such that a processing step is conducted at each processing station, wherein the plurality of processing stations comprises an infeed station for receiving the containers; a filling station for filling the containers with the products; and an output station for dispensing the filled containers; wherein the apparatus is configured to move the containers through the plurality of processing stations in a rotary manner about a substantially horizontal central axis.

Orientating the apparatus such that the containers move in a rotary manner about a horizontal axis substantially reduces the footprint of the apparatus as well as allowing a large number of containers to move between stations as a unit, thus increasing the efficiency of the container processing method.

As noted above, the apparatus receives an empty container and is capable of processing that container so as to fill it with a product, optionally seal the container, and then dispense the filled container for any subsequent processing steps.

The apparatus is configured to carry out a plurality of processing steps on each container. A processing step includes such events as filling product into the container. However, a processing step can also be considered to be a step where the container is simply held at a station without performing any particular action. In other words, a processing step can be a wait step while other containers are undergoing processes at other processing stations.

The apparatus comprises a plurality of processing stations. A processing station is a location of the apparatus where a processing step occurs. The processing stations may have components associated with the function that is performed at that processing station. However, where the processing station is simply associated with a wait step, there may be no particular components associated with that station. All processing stations may have components associated with the function that is performed at each processing station.

As noted above, the apparatus is configured to move the containers through the plurality of processing stations in a rotary manner. The reference to a rotary manner means that the containers follow a path that travels about a central axis. Therefore, the plurality of processing stations are distributed around the central axis such that the containers can move through the plurality of processing stations by travelling about the axis. This central axis is oriented substantially horizontally, and preferably horizontally. In other words, the central axis extends along a horizontal direction.

As used herein, the vertical direction is the local gravity direction, i.e. the direction along which a plumb bob hangs. Accordingly, the horizontal direction is perpendicular to this vertical direction. Therefore, the substantially horizontal central axis of the apparatus is substantially perpendicular to the gravity direction.

By travelling in a rotary manner about a substantially horizontal central axis, the containers are moved through the plurality of processing stations in a substantially vertical plane. Accordingly, a plurality of processing stations are therefore arranged within a substantially vertical plane around the central axis, i.e. the processing stations are arranged around the central axis and within a vertical plane that is perpendicular to the central axis. By moving in a vertical plane, the footprint of the apparatus can be reduced and so provide a more compact design. Further, by moving in a rotary manner about a substantially horizontal axis the containers are more readily accessible to an operator at a given position, since the container changes in vertical height as it moves through the stations. This is in contrast to prior art apparatus where it is known for the containers to move in a linear manner along a horizontal direction, or a rotary manner about a vertical central axis. In such a device, an operator would have to walk along or around the apparatus in order to access the containers at the various stages of their journey.

Further, by moving the containers in a rotary manner about a substantially horizontal central axis, it is possible to process numerous containers at a given station at the same time without greatly increasing the time taken for moving the containers between the stations or significantly increasing the footprint of the apparatus. This is due to the ability to arrange the containers in a row along the direction of the central axis. In this case, the reference to containers travelling in a substantially vertical plane, and processing stations being arranged in a substantially vertical plane, can be considered as a reference to a container at a certain position along the central axis (i.e. one container along the row) and the corresponding processing stations through which that container would travel. The other containers along the row will each travel within their own vertical plane, which will be parallel to the other vertical planes and contain corresponding processing stations.

Various types of processing station can be present in the apparatus of the invention. The number of processing stations can be chosen as required for the particular container processing. There may be four or more processing stations, or five or more processing stations, or six or more processing stations, or seven or more processing stations, or eight or more processing stations, or nine or more processing stations, or ten or more processing stations.

The apparatus comprises an infeed station for receiving the containers. In other words, the infeed station is a station at which the containers are introduced into the apparatus.

The apparatus may comprise a plurality of holders for receiving and conveying the containers through the plurality of processing stations. Each of the holders may be in the form of grippers, which grip the containers in order to carry them through the various processing stations. The grippers may comprise fingers configured to move between an open configuration for receiving the container, and a closed configuration for holding the container. The fingers may comprise a rubber coating to enhance the grip between the gripper and the container. The containers can be conveyed to the apparatus via any suitable means and then transferred by any suitable means to be held in the holders. Such suitable means includes the use of suction caps to which a vacuum can be applied to pick up the containers from one location and place them in the holders.

The apparatus also comprises a filling station for filling the containers with a product. The product is not particularly limited and may be a product in a dry form or a wet form. A product in a wet form may be fully liquid or may have solid component(s) and free liquid component(s). A free liquid component is a component that is free to adopt the shape of the container that it is in. In other words, the free liquid component is liquid that is not bound to, or absorbed within, a solid component. The free liquid component may make up at least 5% of the product by volume.

The product can include products such as foodstuff, in particular pet food which may be in a dry or wet form. The filling station may comprise a nozzle for directing the product into the container. The nozzle may be connected to a hopper in which the product is stored prior to filling into the containers. The nozzle may be opened and closed as required in order to dispense the food product into the container when the nozzle and the container are in the respective filling positions. The number of nozzles may correspond to the number of containers that will be positioned at the filling station at a given time. It is possible to have fewer nozzles than containers at the filling station. However, this would necessitate moving the nozzles and thus impact on the efficiency of the process and increase the complexity of the apparatus.

The apparatus may further comprise additional filling stations. For example, the apparatus may comprise a second filling station. Each filling station may deposit a different product into the container. This is particularly useful approach for filling the containers with a mixture of solid and liquid products, such as foodstuffs. In this situation, one of the filling stations can introduce the solid component of the foodstuff into the container and the other filling station can introduce the liquid component of the foodstuff into the container.

The apparatus further comprises an output station for dispensing the filled containers. At this station the containers are removed from the apparatus and may undergo further processing as part of a separate apparatus. Alternatively, the dispensed containers may be in their finished form ready for shipping. When the containers are conveyed in holders, the holders can release the containers so that they fall from the apparatus. Alternatively, a further component at the output station can carry each of the containers from the apparatus and place them on another apparatus for further processing, the further component may be a suction cap to which a vacuum can be applied for moving the container from the apparatus to another location.

The plurality of processing stations may be arranged at a plurality of different vertical heights. In this manner, the processing stations can be arranged in an efficient manner along the rotary path taken by the containers. Each of the plurality of processing stations may be arranged at a different vertical height.

Each of the plurality of processing stations may be positioned in a different direction from the central axis. This results in the plurality of processing stations being distributed around the central axis. This ensures that the containers will go through each of the processing stations in turn as they proceed around the central axis in a rotary manner. In particular, the plurality of processing stations can be positioned so as to define an elliptical, or circular, path around the central axis. When the plurality of processing stations are arranged along a circular path, each of the plurality of processing stations is the same distance from the central axis.

It is preferred that the travelling distance for the containers between each of the processing stations is the same. In other words, the processing stations are evenly distributed around the central axis. This allows for multiple containers to be moved together by one mechanism and be positioned so that they all align with a respective processing station together, and all leave the previous processing stations and arrive at the next processing stations at the same time when travelling together at the same speed. To achieve this, the processing stations can be arranged at regular angular positions along a circular path around the central axis.

For example, when there are eight processing stations, the processing stations can be arranged at 45° intervals around the central axis.

The apparatus may be configured to position the container at a processing station for a time sufficient for the processing step to be carried out. In other words, the movement of the container is halted for the time that the container is present in a processing station and being processed. Hence, the apparatus moves the containers in an intermittent manner. This reduces the complexity of the apparatus because processing does not need to occur on a moving container. When containers present at each processing station all move at the same time, the containers will need to remain at each of the processing stations for an amount of time that is sufficient for the processing step with the longest processing time to be carried out. In this manner, the rate at which the apparatus processes the containers is limited by the step with the longest processing time.

When there are a plurality of holders they may be arranged into a plurality of units, wherein each unit comprises a plurality of holders. A unit of holders is then processed at the same time at the same station. In this manner, a unit proceeds as a batch through each of the processing stations and so an increased number of holders, and thus containers, can be processed in the apparatus during each processing cycle. The number of holders in each unit may be at least two, at least five, preferably at least ten, more preferably at least 15, maybe at least 20 holders. As explained above, the vertical rotary manner of the apparatus allows for a large number of containers to be conveyed at the same time and also to be accessible to each of the processing stations. The holders can be arranged within a unit along the direction of the horizontal central axis. The holders can be arranged in one row or in multiple rows in each unit, where a row extends along the direction of the horizontal central axis.

The number of holders in a unit can be chosen so that the number of containers that are processed as a batch in one of the units corresponds to the number of containers that are processed as a batch in a step that precedes the introduction of the containers into the apparatus or that follows the dispensing of the containers from the apparatus. This increases the efficiency of the overall process into which the apparatus is incorporated.

The apparatus may further comprise a rotatable frame wherein the plurality of holders are arranged on the rotatable frame, so that the plurality of holders move through the processing stations as the frame rotates. In this manner, each of the holders moves at the same angular speed and has a fixed position relative to each other. The use of a rotatable frame ensures a rigid connection between each of the holders so that their relative positions do not change over time, a problem that can occur when using a chain in order to connect the holders together.

The rotation of the frame may be effected by a motor connected to a central axis of the rotatable frame.

The rotatable frame may be in the form of a wheel. This allows the holders to be present at any position around the wheel, and so increases design flexibility when constructing the apparatus. The frame may be constructed from a metallic material, for example the frame may be constructed from steel.

It is particularly preferred that the number of units is the same as the number of processing stations, and that the plurality of units are arranged so that, at a given time, each unit can be positioned at a respective processing station. This ensures that every processing station is occupied every time a processing step is carried out. This optimises the efficiency of the process.

The apparatus may have a plurality of holders that are configured so as to maintain the containers in the same orientation relative to the vertical direction. This can be achieved by using any suitable means, such as gravity or motors. For example, the holders can be connected to the rest of the apparatus via a connection point, wherein each of the holders is able to freely rotate about the connection point. In this manner, the influence of gravity on the holder can maintain its orientation with respect to the vertical direction. Alternatively, each of the holders can be connected to the rest of the apparatus via a connection point and there is a motor configured to rotate the holder about the connection point, wherein the motor is configured to rotate the holder so as to maintain the orientation of the holders with respect to the vertical direction. By maintaining the containers in the same orientation relative to the vertical direction, the containers are in the position in which they will be filled and thus correct filling of the container can be ensured while not losing any products as the container moves further around the horizontal central axis in a rotary manner.

The apparatus may further comprise a sealing station for sealing the containers. Such a sealing station may comprise a device that is capable of securing a covering for the container. Alternatively, the sealing station may comprise a device that is suitable for sealing the container to itself. For example, the sealing station may heat-seal two parts of the container together or may achieve a seal by using ultrasonic welding. The preferred sealing method is ultrasonic welding, since it performs better with contaminated surfaces, is quicker and does not require a cooling step, in contrast to the heat welding approach.

The apparatus may further comprise a weight check station for weighing the containers. This weight check station may be after the containers have been filled and so can be used to check that a sufficient quantity of product has been included in the containers. The weight check station may comprise a plurality of weighing plates associated with each holder that will be present at the weight check station. In this manner, the container held in the holder may be brought to rest on the weighing plate and its weight measured via a strain gauge. A mechanism may be present for identifying and rejecting those containers which do not fulfil the weight requirement.

The apparatus may further comprise a steam injection station for injecting steam into the containers. The steam injection station may occur after the containers have been filled, but before they have been sealed. Such a steam injection station helps to displace oxygen from inside the container ahead of sealing. It is preferred that the steam injection station closes the container to some degree after the steam injection to minimise further air ingress before sealing. The steam injection station may comprise a nozzle for injecting steam into the containers. Preferably the steam injection station comprises a plurality of nozzles for injecting steam into each container that will be present at the steam injection station. The steam injection station may be further configured with a vacuum system for removing gas from the container prior to injecting steam into the containers. This further reduces the oxygen content in the containers.

The apparatus may further comprise a nitrogen injection station for injecting nitrogen into the containers. The nitrogen injection station may occur after the containers have been filled, but before they have been sealed. Such a nitrogen injection station helps to displace oxygen from inside the container ahead of sealing. It is preferred that the nitrogen injection station closes the container to some degree after the steam injection to minimise further air ingress before sealing. The nitrogen injection station may be present as an alternative to the steam injection station or in addition to the steam injection station. The nitrogen injection station may comprise a nozzle for injecting nitrogen into the containers. Preferably, the nitrogen injection station comprises a plurality of nozzles for injecting nitrogen into each container that will be present at the nitrogen injection station. The nitrogen injection station may be further configured with a vacuum system for removing gas from the container prior to injecting nitrogen into the containers. This further reduces the oxygen content in the containers.

The apparatus may further comprise an opening station for ensuring the containers are open. In other words, the opening station can move the containers from a closed configuration to an open configuration. The opening station is especially relevant for containers that have a degree of flexibility and so have a configuration that can be manipulated in normal use, i.e. pouches. It is preferable that the opening station is positioned before the filling station. In this way, the opening station ensures that the containers are open so that the product can be dispensed into the container at the filling station. The opening can be effected by any suitable means. This can include manipulating a holder of the container so as to change the configuration of the container and/or the utilisation of suction cups to move parts of the container from one configuration to another. The opening station may further comprise a nozzle for injecting air into the container so as to assist with the opening of the container. It is preferable that the opening station comprises a plurality of nozzles for injecting air into each container that is present at the opening station.

The apparatus of the present invention may be configured such that the plurality of processing stations are arranged around a central region. The central region can contain components associated with at least one of the processing stations. Utilising the central region for the location of such components maintains the compactness of the apparatus. In particular, the components situated in the central region could be associated with the filling station. The component in the central region can be removed from the central region. This allows the components to be serviced and also for the central region itself to be serviced, including any mechanisms that contribute to the running of the apparatus.

As noted, the components associated with the filling station may be present in the central region, e.g. the components of the filling station may be present in the central region. In this way, the filling station can be positioned at a low vertical height relative to the other processing stations, in particular, the filling station can be positioned at the lowest vertical height relative to the other processing stations. When there are additional filling stations, all filling stations may be present at lower vertical heights than the other processing stations. When there are two filling stations, both of the two filling stations may be at substantially the same vertical height, which is the lowest vertical height of any processing station. The vertical height is measured in a vertical direction from a baseline, such as the floor on which the apparatus stands, to the lowest part of the respective processing station.

By having the filling stations at relatively low vertical heights the possibility of contamination of the other processing stations and the rest of the apparatus is reduced. Such contamination could occur from product falling out of a container due to agitation of the container during processing, or from inadvertent drips or splashes from the dispensing mechanism during or after filling of the container. The potential contaminants will fall under gravity so having less apparatus and fewer processing stations below the filling station reduces the risk that any such spillages will contaminate parts of the apparatus. Reducing the possibility of such product contamination is particularly beneficial when the product is a foodstuff, since a contaminant may inadvertently be incorporated in a container or on the outer surface of the container, thus spoiling that product. Such cross-contamination may occur indirectly when the contaminant is firstly present on a part of the apparatus, and then after some time falls again towards a container. This is a particular risk to the quality of the final product.

The sealing of the containers is an important step, especially when dealing with a product that is a foodstuff. It is therefore useful to have the sealing station, if present, at an ergonomically sensible height that facilitates ease of inspection. The height can therefore be about eye level of the average user. This ease of inspection is supported by having the filling station at a relatively low vertical height of the apparatus so that the sealing station can be positioned at a higher vertical height than the filling station and thus at a location that is easier to inspect. Also, not having the sealing station at the lowest point of the apparatus ensures that the inspection of the sealing station is easier and any rectification that may be needed can be carried out in an easier manner.

The containers of the present invention can be of any suitable form for receiving product, such as trays. A particularly preferred form of containers are pouches which particularly benefit from the present invention relative to prior art pouch filling approaches. A pouch is a container with flexible walls such that these walls can be manually manipulated. The pouch is substantially constructed from flexible material. The pouch can be constructed by sealing together one, two, three or more separate sheets of flexible material to form a space for receiving the product. The flexible material can be in the form of a film. The film may comprise a thermoplastic. The film may be a laminate film comprising a metallic foil layer, such as an aluminium foil layer. The metallic foil layer can be between two thermoplastic layers.

The present invention also provides a method of processing containers utilising the apparatus described herein, comprising the following steps: receiving a container at the infeed station; conveying the container to the filling station; filling the container with a product at the filling station; conveying the container to the output station; and dispensing the filled containers at the output station.

Further provided is a method of processing a container, wherein the method comprises the following steps: introducing a container into an apparatus at an infeed station; conveying the container to a filling station of the apparatus; filling the container with a product at the filling station; conveying the container to an output station of the apparatus; and dispensing the filled container from the apparatus at the output station; wherein the conveying steps move the container in a rotary manner about a substantially horizontal central axis.

The conveying steps of the method of the present invention may move the container in a substantially vertical plane around the central axis. The conveying steps may move the container along a substantially elliptical path around the central axis, specifically the conveying steps may move the container along a substantially circular path around the central axis.

The method may comprise processing a plurality of containers simultaneously. In other words, a plurality of containers are conveyed together and processed together at the stations of the apparatus.

As described herein, various processing stations may be present. Therefore, the method may further comprise conveying the container to these processing stations and processing the container at the processing station. Such possible processing stations include a sealing station, a weight-check station, a steam-injection station and/or an opening station.

The method may further comprise conveying the container to various other stations described herein which may be present before or after and/or between the various stations described above.

The invention will now be described with reference to the figures.

FIG. 1 depicts a schematic representation of the apparatus of the present invention. The apparatus 2 has eight processing stations 4, 6, 8, 10, 12, 14, 16, 18. The apparatus is configured to move a container through each of the processing stations in an intermittent manner. Therefore, the container spends time stationary at each of the 8 processing stations as a processing step is conducted.

The processing stations are arranged along a circular path around a central horizontal axis 20. Each of the processing stations is arranged at an interval of 45° around the central horizontal axis. In this manner, the processing stations are evenly distributed around the central axis.

The movement of a single container through the apparatus will now be described.

Firstly, the container is introduced at the infeed station 4. This is the first time the container enters the apparatus 2. At the infeed station 4 the container is introduced into a holder that will convey the container through the rest of the processing stations of the apparatus 2.

Next, the apparatus 2 effects a rotation of 45° around the central axis so that the holder moves from the infeed station 4 to the opening station 6. The movement of the container stops and the processing step of opening the container is effected. This involves moving the container, which in this example is in the form of a pouch, from a closed configuration to an open configuration such that an opening at the top of the container is present so as to receive a food product.

After the opening step, the apparatus 2 moves the container again through 45° around the central axis so as to arrive at the first filling station 8. The first filling station 8 introduces solid food product into the pouch from the solid filling components 9 that are positioned within a central region of the apparatus 2 (alternatively, the first filling station could introduce liquid food product). The filling components 9 can comprise a hopper and a plurality of nozzles to go into each container that is present in the filling station 8.

Next the apparatus 2 rotates the container through another 45° about the central axis to arrive at the second filling station 10. The second filling station 10 is a liquid filling station for injecting liquid food product into the pouch. Again, the components associated with the liquid filling station 10 are present in the central region of the apparatus 2. Also, the second filling station 10 comprises a hopper and a plurality of nozzles for injecting the fluid into the number of containers that are present at one time in the second filling station 10 (alternatively, the second filling station could introduce solid food product).

Now that the pouch has been filled with all the food product required, it is rotated 45° around the central axis to arrive at the steam injection station 12 where it rests while steam is injected into the pouch in order to reduce the oxygen content in the head space of the pouch. The steam injection station 12 can also comprise a plurality of nozzles corresponding to the number of pouches that are present at the same time in the steam injection station 12.

Following steam injection, the pouch is again rotated through 45° about the central axis 20 so as to arrive at the ultrasonic sealing station 14. Here, the pouches are sealed by an ultrasonic device which produces an ultrasonic weld across the opening of the pouches.

After the sealing station 14, the pouch is again rotated about the central axis 20 by 45° to arrive at the weight check station 16 where the weight of the filled pouches is checked to evaluate whether the pouches have been sufficiently filled.

Following the weight check station 16, the pouches are yet again rotated through another 45° to arrive at an output station 18 where the filled pouch is dispensed down a chute for subsequent processing.

The journey of a container through the apparatus 2 has been described. It should be noted that when the apparatus is in full operation, containers will be present at all of the processing stations during each processing step so that the maximum number of containers are efficiently processed by proceeding through the apparatus in batches.

Figure 2:
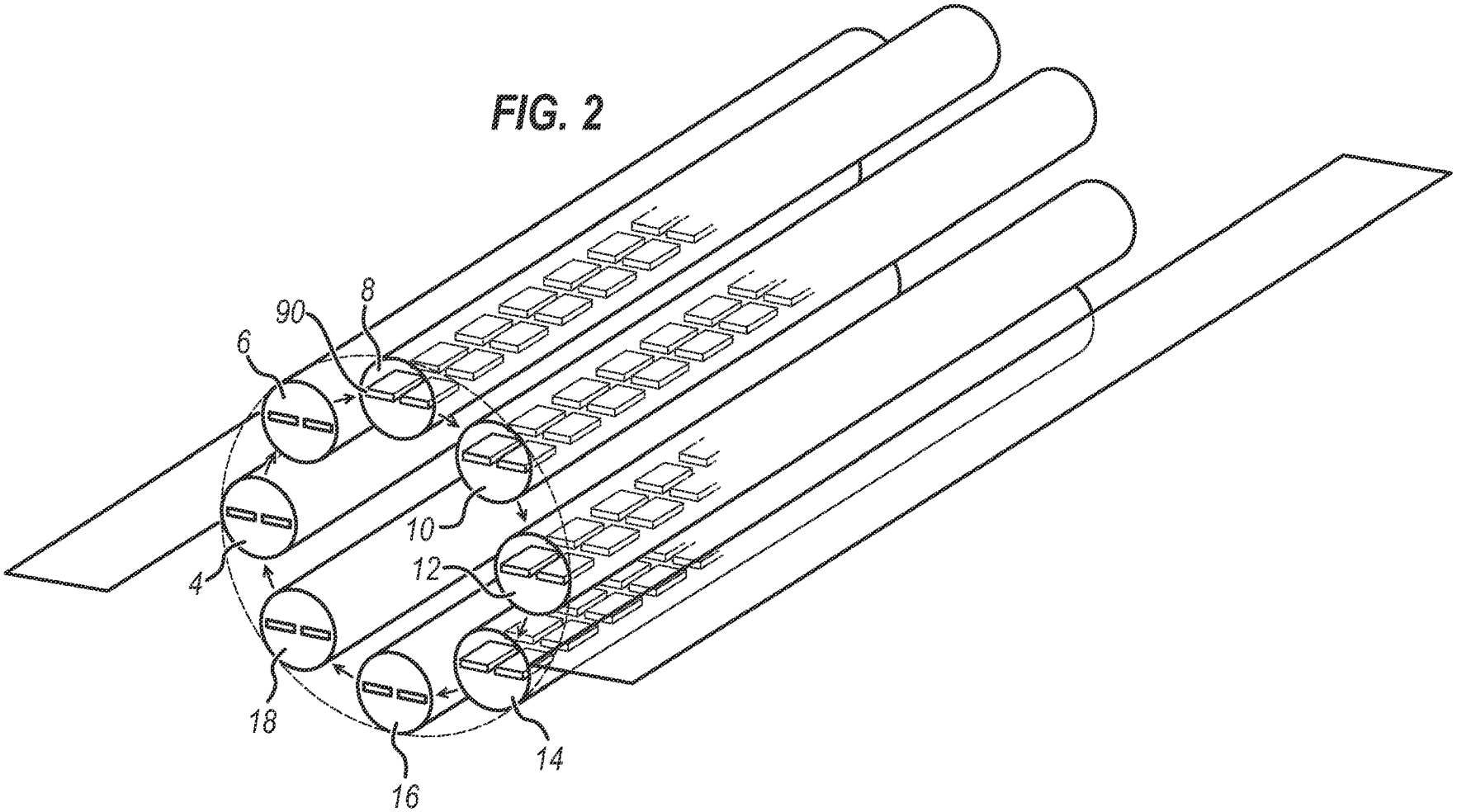
FIG. 2 depicts a further schematic representation of an apparatus of the present invention.

FIG. 2 depicts a perspective view of an apparatus according to the present invention. The eight processing stations are schematically depicted as cylindrical processing areas 4, 6, 8, 10, 12, 14, 16, 18. In each of the processing areas is positioned two rows of holders, each row comprising 20 holders 90 arranged along the central horizontal axis (not all of the holders are shown in FIG. 2). Therefore, there are 40 pouches that can be present at the same time at a processing station. This vastly increases the number of pouches that can be processed at the same time, and so increases the efficiency of the filling process. Although two rows of 20 pouches has been described in relation to FIG. 2, any number of pouches could be contained within the apparatus as required.

The foregoing describes the specific details of the apparatus and method of the present invention. However, these details should not be considered limiting. The invention is defined by the following claims.

The invention claimed is:

1. An apparatus for conducting a plurality of processing steps, the apparatus comprising:

a plurality of processing stations arranged in planes of processing stations, wherein the apparatus is configured such that a processing step is conducted at each processing station of the plurality of processing stations, wherein each plane of processing stations includes:

an infeed station for receiving containers;

a filling station for filling the containers with a product; and an output station for dispensing the filled containers, wherein the containers are disposed in adjacent rows, each row being arranged along a respective axis that is parallel to a central axis of the apparatus, the central axis being substantially horizontal, wherein the apparatus is configured to move the containers simultaneously through the plurality of processing stations in a rotary manner about the central axis, wherein the central axis extends perpendicular to each plane corresponding to a respective one of the planes of processing stations, and wherein each processing station is configured to receive a respective pair of adjacent containers disposed along a respective plane that is perpendicular to a plane of a respective plane of processing stations.

2. The apparatus of claim 1, wherein a plane of each plane of the planes of processing stations is a substantially vertical plane perpendicular to the central axis.

3. The apparatus of claim 1, wherein processing stations for at least one plane of processing stations are arranged at a plurality of different vertical heights.

4. The apparatus of claim 1, wherein each processing station for at least one plane of processing stations is positioned in a respective direction relative to the central axis.

5. The apparatus of claim 1, wherein an arrangement of processing stations for at least one plane of processing stations defines an elliptical path around the central axis.

6. The apparatus of claim 1, further comprising a plurality of holders for receiving and conveying the containers through the plurality of processing stations.

7. The apparatus of claim 6, wherein each of the plurality of holders is capable of conveying a container through each of the plurality of processing stations.

8. The apparatus of claim 7, wherein the apparatus is configured to position a holder at a processing station for a time sufficient for the processing step to be carried out.

9. The apparatus of claim 6, wherein the plurality of holders are arranged into a plurality of units, wherein each unit comprises at least 10 holders.

10. The apparatus of claim 6, further comprising a rotatable frame, wherein the plurality of holders are arranged on the rotatable frame so that the plurality of holders move through the plurality of processing stations as the frame rotates.

11. The apparatus of claim 10, wherein the rotatable frame is in the form of a wheel.

12. The apparatus of claim 9, wherein a number of units of the plurality of units is the same as a number of processing stations of the plurality of processing stations and the plurality of units are arranged so that, at a given time, each unit can be positioned at a respective processing station.

13. The apparatus of claim 6, wherein the plurality of holders are configured so as to maintain the containers in the same orientation relative to a vertical direction.

14. The apparatus of claim 1, wherein at least one plane of processing stations includes a sealing station for sealing respective containers.

15. The apparatus of claim 1, wherein at least one plane of processing stations comprises a weight-check station for weighing respective containers.

16. The apparatus of claim 1, wherein at least one plane of processing stations comprises a steam-injection station for injecting steam into respective containers.

17. The apparatus of claim 1, wherein at least one plane of processing stations comprises an opening station configured to ensure respective containers are open.

18. The apparatus of claim 1, wherein at least one plane of processing stations is arranged around a central region containing components associated with processing stations of the at least one plane of processing stations.

19. The apparatus of claim 18, wherein the components are associated with a filling station of the at least one plane of processing stations.

20. The apparatus of claim 19, wherein the filling station is at the lowest vertical height of all processing stations of the at least one plane of processing stations.

21. The apparatus of claim 18, wherein the components can be removed from the central region.

22. The apparatus of claim 1, wherein the containers are in the form of pouches.

23. A method comprising:

introducing containers into infeed stations of respective planes of processing stations of an apparatus;

simultaneously conveying the containers to filling stations of respective planes of processing stations of the apparatus;

simultaneously filling the containers with a product at the filling stations;

simultaneously conveying the containers to output stations of respective planes of processing stations of the apparatus; and simultaneously dispensing filled containers from the apparatus at the output stations, wherein the conveying steps move the containers simultaneously to the processing stations in a rotary manner about a central axis, the central axis being substantially horizontal, wherein the containers are disposed in adjacent rows, each row being arranged along a respective axis that is parallel to the central axis of the apparatus, wherein the central axis extends perpendicular to planes corresponding to the planes of processing stations, and wherein each processing station is configured to receive a respective pair of adjacent containers disposed along a respective plane that is perpendicular to a plane of a respective plane of processing stations.

24. The method of claim 23, wherein the conveying steps move the containers in substantially vertical planes perpendicular to the central axis.

25. The method of claim 23, wherein the conveying steps move at least one container along a substantially elliptical path around the central axis.

26. The method of claim 23, wherein the method comprises processing the containers simultaneously.

27. The method of claim 23, further comprising the steps of conveying at least one container to a sealing station of at least one plane of processing stations of the apparatus; and sealing the at least one container at the sealing station.

28. The method of claim 23, further comprising the steps of conveying at least one container to a weight-check station of at least one plane of processing stations of the apparatus; and weighing the at least one container at the weight-check station.

29. The method of claim 23, further comprising the steps of conveying at least one container to a steam-injection station of at least one plane of processing stations of the apparatus; and injecting steam into the at least one container at the steam-injection station.

30. The method of claim 23, further comprising the steps of conveying at least one container to an opening station at least one plane of processing stations of the apparatus; and opening the at least one container at the opening station.

31. The method of claim 23, wherein at least one container is a pouch.

32. The method of claim 23, wherein the apparatus is configured according to the apparatus of claim 1.

* * * * *